United States Patent [19]

Chang

[11] Patent Number: 4,608,184

[45] Date of Patent: Aug. 26, 1986

[54] PHENATE PROCESS AND COMPOSITION IMPROVEMENT

[75] Inventor: Yuehsiung Chang, Naperville, Ill.

[73] Assignee: Amoco Corporation, Chicago, Ill.

[21] Appl. No.: 754,647

[22] Filed: Jul. 12, 1985

[51] Int. Cl.[4] ..... C10M 125/22; C10M 141/02

[52] U.S. Cl. ..... 252/42.7

[58] Field of Search ..... 252/42.7

[56] References Cited

U.S. PATENT DOCUMENTS 2,680,096 6/1958 Walker et al. ..... 252/42.7
3,549,534 12/1970 Holstedt et al. ..... 252/42.7
3,969,235 7/1976 Sung et al. ..... 252/42.7
4,171,270 10/1979 Sung et al. ..... 252/42.7

*Primary Examiner*—William R. Dixon, Jr.
*Assistant Examiner*—Ellen M. McAvoy
*Attorney, Agent, or Firm*—William C. Clarke; William T. McClain; William H. Magidson

[57] ABSTRACT

A process is disclosed for preparation of a lubricating oil additive comprising an improved sulfurized alkaline earth metal alkylphenate and the composition thereof wherein the said composition has a ratio of infrared absorbencies of A1660 $cm^{-1}$/A1600 $cm^{-1}$ of less than 0.2 and less than 0.2 for the ratio of A1080 $cm^{-1}$/A835 $cm^{-1}$.

15 Claims, 1 Drawing Figure

A CONTINUOUS PHENATE PROCESS

A CONTINUOUS PHENATE PROCESS

PHENATE PROCESS AND COMPOSITION IMPROVEMENT

FIELD OF THIS INVENTION

The field of this invention relates to an improved process for preparation of an additive for lubricating oils whereby an improved sulfurized calcium alkylphenolate (phenate) composition is obtained which is more effective in preventing engine deposits and, thereby, improves efficiency of an internal combustion engine.

It is an object of this invention to provide a lubricant composition which provides improved heavy-duty engine performance by improved detergent and antioxidant ability. Sulfurized calcium alkylphenates are used as compounding agents in diesel-engine lubricating oils to neutralize acids formed during the combustion process, as detergents to prevent engine deposits and an antioxidants to improve the oil resistance to oxidation and concurrent formation of gum deposits.

It is an object of this invention to provide an improved sulfurized calcium alkylphenate composition which demonstrates improved railroad diesel engine performance when incorporated into a lubricating oil composition.

It is an object of this invention to provide a process for preparation of an improved sulfurized calcium alkylphenate composition which demonstrates improved engine performance over previously available sulfurized calcium alkylphenates.

It is a further object of this invention to provide a continuous process for preparation of improved sulfurized calcium alkylphenate with improved engine performance properties.

It is further an object of this invention to prepare a sulfurized calcium alkylphenate composition with a high total base number (TBN) to calcium ratio.

These and other objects of this invention will become apparent from the description given hereby.

BACKGROUND OF THE INVENTION

This invention is concerned with the improvement of the detergent and antioxidant ability of a particular class of compounds which have been taught in the prior art as highly effective detergent additives for lubricating oils. These compounds, so-called "over-based" metal derivatives of phenolic-type compounds, are described in U.S Pat. No. 2,680,096.

U.S. Pat. No. 2,680,096 teaches basic calcium phenates which contain a ratio of equivalents of calcium to equivalents of phenol which is substantially greater than that of the "normal" sulfurized calcium phenates. They contain up to 200 mole percent of calcium per mole of phenol. The prior art has recognized that the excess calcium contents of these detergent additives makes them more effective detergent additives than the normal basic sulfurized calcium phenates.

The conventional procedure for forming the over-based sulfurized calcium phenate salts requires a considerable excess of a calcium compound which can be in the form of calcium oxide or calcium hydroxide. In the prior art it has been found that neutralization of the phenolic compound in the presence of a polyhydroxy organic compound provides a product containing a higher percentage of metal than does the product produced in the absence of the polyhydroxy organic compound. This procedure is described in U.S. Pat. No. 2,680,096.

U.S. Pat. No. 2,680,096 teaches that treatment of phenol with an excess amount of a neutralizing agent in the presence of a minor amount of a polyhydroxy organic compound such as a low molecular weight polyhydric alcohol having in the range 2 to 6 carbon atoms results in a product with increased metal content. Less neutralizing agent is accordingly required to obtain a product with a given metal content. The polyhydroxy compounds used can include ethylene glycol, propylene glycol; butanediol-2,3; pentanediol-2,3; and 2-methylbutanediol-3,4. Because of the higher yield of product obtained, ethylene glycol is the preferred solvent.

Referring again to U.S. Pat. No. 2,680,096, it is seen that the basic sulfurized calcium phenates are prepared from either normal calcium phenates or phenols as starting materials. When phenols are used as the starting material, they are treated with calcium oxide or hydroxide to form the desired normal calcium phenate which are then treated further with calcium oxide or calcium hydroxide in the presence of glycols to form the sulfurized basic calcium phenates. The phenols can also be treated with calcium oxide or hydroxide in amounts to form the sulfurized basic calcium phenates directly by reaction of the phenols with calcium oxide or hydroxide and sulfur in the presence of glycols.

Other investigators in the sulfurized metal phenate field have formulated various types of compounds. Typical investigations are disclosed in U.S. Pat. Nos. 2,680,097; 2,766,291; 3,036,971; 3,178,368; 3,801,507 and others.

U.S. Pat. No. 3,801,507 teaches that sulfurized metal phenates having improved antioxidant activity and dispersancy are prepared by reacting an alkaline earth metal base with a sulfurized alkylphenol and having an average sulfur-to-metal atom ratio between 1 and 4. The compounds are prepared in a two step reaction procedure in which 1.0 to 5 moles of sulfur and from 0.05 to 1.5 moles, preferably 0.2 to 1.0, mole of alkaline earth metal base are contacted in a first step with each mole of an alkylphenol having from 8 to 35 carbons in the alkyl group. The contacting is conducted in the presence of 0.1 to 4 moles, and preferably from 0.2 to 1 mole, of a mutual solvent having solvency for the alkylphenol and alkaline earth metal base per mole of alkylphenol. In a second step, the sulfurized reaction product above is contacted with zero to 1.45 moles of additional alkaline earth metal base and 0.5 to 4 moles of mutual solvent per mole of original alkylphenol under conditions conducive to the formation of the sulfurized alkaline earth metal phenate product.

Hydrogen sulfide and water are evolved in both the first and second steps of the U.S. Pat. No. 3,801,507 process. The patent also teaches, colum 4, lines 66–70, delayed removal of the hydrogen sulfide and water vapor encourages the oxidation of some of the mutual solvent, such as ethylene glycol, to glycolic acid, oxalic acid, etc., which in turn react with the metal base and reduce the base reserve of the product. The alkalinity value (ASTM Test D-2896) of the sulfurized metal phenate, hereinafter referred to as total base number (TEN) ranges from 40 to 200 mg KOH/gram and more usually from 90 to 150 mg KOH/gram.

It has now been found in accordance with the present invention that the effectiveness of the basic sulfurized calcium phenates can be substantially increased in a batch or continuous process wherein formation of neutral calcium compounds is reduced to a minimum by the invented method of reacting the reaction compounds and the sulfur/calcium/glycol/alkylphenol mole ratios. The reaction between the alkylphenol, glycol and calcium compound in a prereaction step is critically controlled as to temperature and reaction time. Sulfur is not added to the reaction mixture until the glycol has formed a reaction intermediate with the alkylphenol and calcium compound.

In the prior art, it is taught to react a mixture of a calcium compound, sulfur and a polyhydroxy compound such as ethylene glycol and an alkylphenol to prepare a sulfurized calcium alkylphenate. For example, U.S. Pat. No. 2,680,096 teaches that it is essential (column 2, lines 32–35) the elemental sulfur be present along with the calcium oxide or calcium hydroxide, glycol and alkylphenol. U.S. Pat. No. b 3,801,507 teaches that the three reactants of sulfur, alkylphenol and alkaline earth metal oxide or hydroxide are brought together in the presence of a mutual solvent which can be glycol. U.S. Pat. No. 3,801,507 teaches that the concentration of alkylphenol, alkaline earth metal base, sulfur and mutual solvent is not important and can vary with selection of reactants and process conditions, etc.

Contrary to the teachings of the prior art, it has been found that formation of a neutral calcium compound is promoted in a reaction mixture when a calcium compound is heated in the presence of glycol and sulfur. The presence of the neutral calcium compound, which can be calcium oxalate, reduces the effectiveness of the sulfurized calcium alkylphenate as a lubricating oil additive in preventing engine deposits and as an antioxidant. It has also been found that critical mole ratios of lime, glycol and alkylphenol minimize the formation of undesirable glycol complexes. Formation of neutral calcium compounds and these undesirable complexes from glycol wastes materials and lessens quality control of the final lubricant additive and the lubricating oil containing the additive.

Accordingly, in the prior art there was no recognition that a process which reacted the glycol with the calcium compound and alkylphenol in critical mole ratios in the absence of sulfur to form an intermediate would reduce the presence of a neutral calcium compound in the final product, the presence of which could be monitored by infrared analysis.

BRIEF DESCRIPTION OF THE DRAWING

The sole drawing shows the proposed reaction scheme in black diagram form.

SUMMARY OF THE INVENTION

Figure 1:
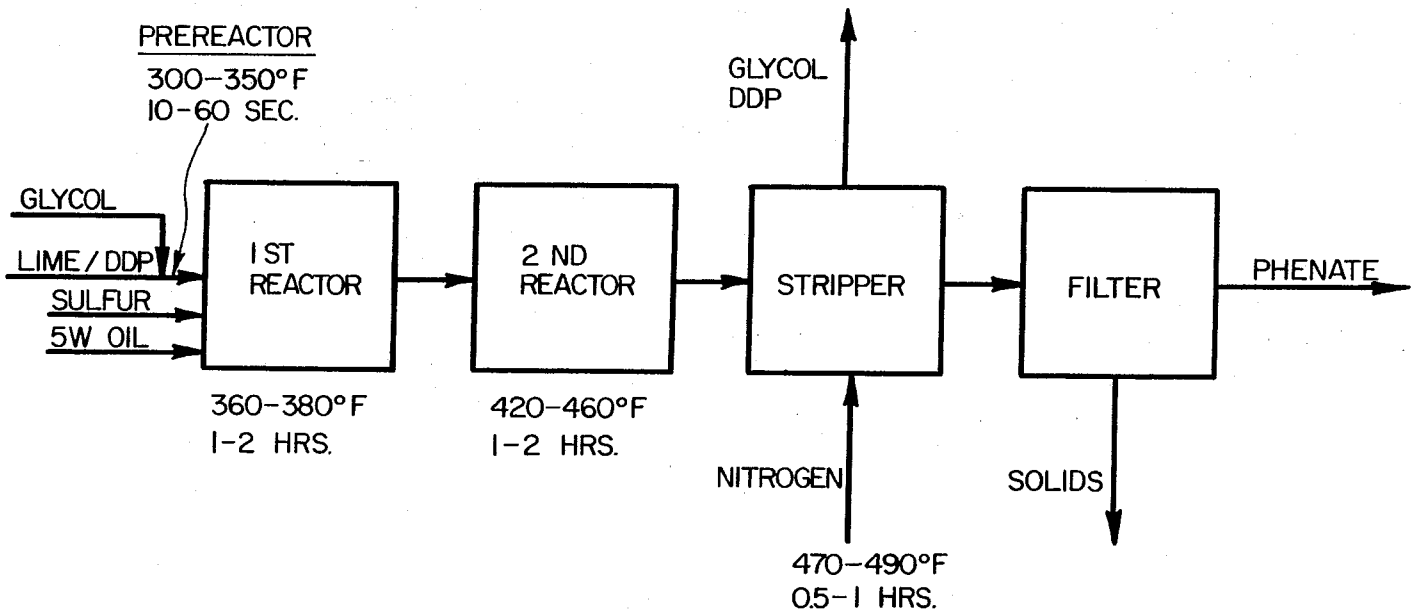

A process is disclosed for preparation of a sulfurized calcium phenate with improved antioxidant and dispersancy properties in a lubricating oil composition wherein formation is minimized of glycol complexes as measured by a ratio of less than 0.2 of infrared absorbances at about 1080 $cm^{-1}$ and about 835 $cm^{-1}$, and neutral forms of calcium as measured by a ratio of less than 0.2 of infrared absorbances at about 1660 $cm^{-1}$ and about 1600 $cm^{-1}$. Mole ratios of reaction components and reaction conditions are essential elements of the process.

DETAILED DESCRIPTION OF THE INVENTION

It has now been found, in accordance with the present invention, that the effectiveness of sulfurized calcium alkylphenate as a lubricating oil additive can be enhanced by preventing the excessive formation of neutral calcium compounds or a modified form of glycol complexes and neutral calcium compounds, thus reducing the need for excessive use of glycol and sulfur, as taught in the prior art. It has been found that a form of a neutral calcium compound can be formed by the reaction of glycol and calcium oxide or calcium hydroxide when glycol is present as a solvent in the reaction of the calcium compound with sulfur and a phenolic compound. The total base number (TBN) of the resulting sulfurized calcium phenate is accordingly less than would be indicated by the amount of calcium present in the compound.

The chemistry of the reactions involved when employing the glycol as a solvent is quite obscure. It is not desired to be bound by any particular theory or hypothesis as to what occurs during the reaction of a calcium compound with sulfur and a phenolic compound in the presence of a glycol; however, the presence of the glycol can have a neutralizing effect upon the sulfurized calcium alkylphenate by formation of a neutral calcium compound such as calcium oxalate.

The process of the instant invention in the presence of glycol yields a product with a lower glycol content and a higher TBN/calcium ratio than a product prepared in a conventional procedure in the presence of glycol. The resulting product of the instant invention gave an improved railroad diesel engine performance when incorporated into a lubricating oil composition over the performance obtained with a sulfurized calcium alkylphenate prepared in a conventional manner.

It has now been discovered that a low base calcium phenate lubricating oil additive with improved lubricating oil properties in a railroad diesel application can be prepared by forming a calcium compound, alkylphenol and glycol intermediate in a prereaction step before reacting the above compounds with sulfur to form a sulfurized calcium phenate.

The above process can be carried out by mixing the above first three compounds and heating the mixture for a period of from 10 up to 60 seconds at a temperature within the range of from about 300° F. to about 350° F. Heating the mixture for periods longer than 60 seconds causes the mixture to become less fluid and to form a heavy paste-like material. Heating the mixture for periods less than 10 seconds prevents the formation of a suitable reaction intermediate. Sulfur is then added to the reaction mixture which is heated at a temperature of from about 360° F. to about 380° F. for a period of from 1 to 2 hours. The temperature is then increased to within the range of from about 420° F. to 460° F. for 1 to 2 hours. Excess glycol and unreacted alkylphenol are then nitrogen-stripped from the reaction mixture at a temperature within the range of from about 470° F. to about 490° F. for a period of 0.5 to 1 hour. The stripped product is filtered to remove solids.

In accordance with this invention, it has been discovered that excessive formation of neutral calcium compounds can be reduced, when glycol is used as the solvent, by a short pretreatment of from 10 to 60 seconds, of the glycol and the calcium compound in the presence of the phenolic compound as a carrier. The calcium/glycol reactant product and the phenolic compound are then introduced into the process reactor with sulfur and lubricating oil as a mixture to form the final reactant mixture.

The above processing steps can be performed by either a batch or continuous processing method, however, for purposes of control of process parameters, it has been found advantageous to use a system of continuous processing. As indicated above, pretreatment of the glycol/calcium compound for periods longer than 60 seconds causes the resulting product to become difficult to pump; pretreatment for periods less than 10 seconds prevents formation of the chemical intermediates necessary for obtaining the required final product. Batch processing of the glycol/calcium compound accordingly tends to result in a product exceedingly viscous and difficult to handle. Continuous processing avoids these difficulties.

Although the above processing steps can be performed by either continuous or batch processing method, for purpose of illustration only, the following discussion is related to continuous processing. A schematic flow diagram of the continuous process is shown in FIG. 1. The mixture of an alkylphenol and lime is prereacted with glycol in a preheating section prior to the introduction of the sulfur. When the sulfur is introduced into the first reactor, water vapor and hydrogen sulfide gas are evolved. Most of this reaction occurs in the first reactor, but it is not completed until the second reactor. A reaction diluent is preferably provided so as to allow easy handling of the reaction products during the processing steps. After the reaction, the crude product is stripped to remove glycol and unreacted alkylphenol, then filtered to remove solids.

The alkylphenols useful in this invention are of the formula ($R(C_6H_4)OH$ wherein R is a straight chain or branched chain alkyl group having from 8 to 40 carbon atoms and preferably from 10 to 30 carbon atoms, and the moiety ($C_6H_4$) is a benzene ring. Examples of suitable alkyl groups are octyl, decyl, dodecyl, tetradecyl, hexadecyl, triacontyl, etc., up to tetracontyl.

The glycols used in the present invention can contain up to 6 carbon atoms. Suitable glycols include: ethylene glycol; propylene glycol; butane diol-2,3; pentane diol-2,3; and 2-methylbutane diol-3,4. Ethylene glycol is the preferred glycol because of higher reaction yield.

The calcium compound can be either calcium oxide or calcium hydroxide. Calcium hydroxide, as hydrated lime, is preferred for the continuous feeding.

The mole ratios of the reactants are critical. Although the mole ratios of glycol to calcium can vary slightly, it is preferred that the mole ratio of glycol in the reactant mixture be equal to that of the calcium hydroxide. Preferred reaction stoichiometry, including the reaction diluent, e.g., a hydrocarbon such as a 5W petroleum oil, is as follows:

| | | |
|---|---|---|
| Lime; | moles/mole alkylphenol | 0.6–0.8 |
| Sulfur: | moles/mole alkylphenol | 0.8–1.2 |
| Glycol: | moles/mole alkylphenol | 0.6–0.8 |
| 5W Oil; | lbs/mole alkylphenol | 150–300 |

The temperatures at which the reactants will react in the prereaction between the glycol and lime in the presence of the alkylphenol are dependent upon the nature of the reactants. Ethylene glycol, dodecylphenol and lime pre-reaction mixtures will react to form a suitable reaction intermediate at 300° F. to 350° F. at atmospheric pressure. The reaction intermediate and sulfur are reacted at 360° F. to 380° F. for a nominal residence time of from 1 to 2 hours and at 420° F. to 460° for an additional 1 to 2 hours at atmospheric pressure. Although the reactions take place at atmospheric pressure, pressures less than atmospheric can be used to reduce reaction temperatures.

The reaction diluent can be any lubricating oil such as would be used in the final lubricating oil formulation. These lubricating oils include naphthenic base, paraffin base, and mixed base mineral oils and other hydrocarbon lubricants such as synthetic lubricating oils and lubricating oil derived from coal products.

Because of the critical reaction stoichiometry, it is preferred to monitor the reaction process with suitable analytical techniques. It has been found the presence of neutralized calcium compounds can be detected by infrared spectroscopy (IR) at about 1660 $cm^{-1}$ and is primarily affected by the sulfur and glycol reaction stoichiometry. An IR 1080 $cm^{-1}$ peak has been found to relate to undesirable calcium-glycol complexes which contribute to engine deposits. It has been found that a preferred reaction product has a desired minimal content of non-basic calcium as measured by a ratio of less than 0.2 of infrared absorbances at about 1660 $cm^{-1}$ and about 1600 $cm^{-1}$, and a desired minimal content of glycol complexes as measured by a ratio of less than 0.2 of infrared absorbances at about $1080^{-1}$ and about 835 $cm^{-1}$.

The above prepared lubricant additive when formulated into a lubricating oil formulation for use in railroad diesel engines resulted in improved detergency characteristics and anti-oxidant properties. Tests were performed in a Caterpillar 1-G2 diesel test. This engine test uses a 133.5 CID supercharged single cylinder diesel engine at 1800 RPM with 5850 BTU/minute 0.4 (wt)% sulfur fuel input while oil temperature is maintained at 205° F. (96° C.). The following lubricating oil characteristics are determined: (a) ring sticking; (b) ring and cylinder wear, and (c) accumulation of piston deposits.

The final product of the instant invention has a metal content which ranges from 4.0 to about 6.0 (wt) percent and a sulfur content which ranges from about 2.4 to about 3.6 (wt%). The alkalinity value (ASTM Test D-2896) of the sulfurized metal phenate is from about 110 to about 165 mg KOH/gram.

The lubricant composition of this invention can be prepared by simply mixing the sulfurized calcium alkylphenate prepared as a concentrate into a suitable lubricating oil or lubricating oil composition. The concentration of the sulfurized calcium alkylphenate in the lubricating oil composition can vary, depending upon the characteristics of the lubricating base oil used and type of sulfurized metal phenate selected The lubricating oil useful as a base oil in this invention includes natural oils which can be naphthenic base, paraffin base and mixed base and synthetic oils. Other hydrocarbon oils can be derived from coal sources and synthetic compounds such as alkylene polymers, carboxylic acid esters, etc.

Other additives may be employed in the lubricating oil composition such as viscosity index improvers, antiwear agents, antioxidants, lubricating agents, anti-rust agents, extreme pressure agents, pour point depressants, dispersants, dyes and other conventionally used additives in lubricating oils.

In summary, the instant invented process comprises a method for preparing a lubricant oil additive with improved dispersant and antioxidant capabilities which comprises (a) prereacting in preferred mole quantities a polyhydroxy compound such as a glycol with an alkaline earth metal compound such as calcium oxide or calcium hydroxide in the presence of an alkylphenol for a period of from about 10 to 60 seconds at a temperature within the range of from 300° to about 350° F., thereupon adding elemental sulfur to the prereaction mixture and reacting the resultant mixture for a period of from 1 to 2 hours with evolution of water vapor and hydrogen sulfide gas at a temperature of from 360° F. to about 380° F., then (c) finishing the reaction at a temperature within the range of from about 420° F. to about 460° F. for a period of from 1 to 2 hours, (d) nitrogen-stripping the resulting reaction product to remove polyhydroxy compound and unreacted alkylphenol at a temperature within the range of from about 470° F. to about 490° F. for 0.5 to 1 hour, and (e) filtering the reaction product whereby the final reaction product, upon infrared spectroscopic analysis, has a minimal non-basic calcium content, as measured by a ratio of less than 0.2 of infrared absorbances at about 1660 $cm^{-1}$ and about 1600 $cm^{-1}$, and has a minimal glycol complexes content, as measured by a ratio of less than 0.2 of infrared absorbances at about 1080 $cm^{-1}$ and about 835 $cm^{-1}$. Excessive non-basic calcium or glycol complexes content results in poor performance in a Caterpillar 1G2 engine test. The preferred mole ratio quantities are lime, moles per mole of alkylphenol: 0.6–0.8; sulfur, moles per mole of alkylphenol: 0.8–1.2; and polyhydroxy compound: moles per mole of alkylphenol: 0.6–0.8. A diluent oil can be added in pounds/mole of alkylphenol: 150–300 lbs.

The following examples are illustrative of typical embodiments of this invention and should not be considered as limiting the scope of the invented process and composition.

EXAMPLE I

Thirteen samples of sulfurized calcium dodecylphenate were prepared. Sample No. 163-1 was prepared in a continuous process according to the method of the instant invention. Mole ratios for No. 163-1 were glycol (ethylene glycol)—0.6 moles; dodecylphenol—1.0 mole; calcium hydroxide (hydrated lime)—0.7 moles; sulfur—0.9 moles. The other samples were prepared in a conventional procedure using higher glycol stoichiometry to determine the range of the TBN/calcium ratio as related to the A1660 $cm^{-1}$/A1600 $cm^{-1}$ ratio. The 1660 $cm^{-1}$ and 1600 $cm^{-1}$, infrared absorbance intensities were measured for each. The alkalinity value (TBN) of each was determined (ASTM D-2896). The percent calcium and sulfur of each sample was determined by X-ray diffraction. The results are summarized in Table I.

TABLE I

| Sample No. | Ca (wt) % | S (wt) % | TBN | TBN/Ca | A1660 $cm^{-1}$/A1600 $cm^{-1}$ |
|---|---|---|---|---|---|
| PS-0479 | 4.90 | 3.21 | 127 | 25.9 | 1.33 |
| 124-2 | 4.89 | 2.66 | 111 | 22.7 | 1.71 |
| 142 | 5.00 | 2.49 | 138 | 27.6 | 0.98 |
| 3390 | 4.59 | 2.84 | 125 | 27.2 | 0.90 |
| 163-2 | 5.81 | 3.98 | 165 | 28.4 | 0.52 |
| 122-5 | 4.60 | 2.73 | 128 | 27.8 | 0.35 |
| 0812 | 4.48 | 2.80 | 120 | 26.7 | 0.45 |
| 101-3 | 4.62 | 2.72 | 129 | 28.0 | 0.50 |
| 124-1 | 4.61 | 2.65 | 129 | 28.0 | 0.38 |
| 151 | 5.18 | 3.12 | 149 | 28.7 | 0.35 |
| 163-1 | 5.43 | 2.48 | 152 | 28.1 | 0.12 |
| 116 | 4.85 | 2.80 | 120 | 25.0 | 0.82 |

TABLE I-continued

| Sample No. | Ca (wt) % | S (wt) % | TBN | TBN/Ca | A1660 $cm^{-1}$/A1600 $cm^{-1}$ |
|---|---|---|---|---|---|
| 161 | 4.56 | 3.21 | 109 | 23.9 | 1.29 |

The above data indicate that as the ratio of A1660 $cm^{-1}$/A1600 $cm^{-1}$ became less than 1, and preferably less than 0.50, the TBN/Ca ratio increased, even though the calcium content was approximately the same, or even decreased, indicating that total calcium content was not completely determinative of the total base number (TBN) of the compound.

EXAMPLES II AND III

Table II summarizes the reaction stoichiometry and processing conditions for the continuous production of sulfurized calcium alkylphenate samples, denominated by PS-115 and PS-1233. PS-1233 represents an attempt to duplicate PS-115 but less diluent oil was used to increase the product concentration. The phenate product was a dark brown material. The 1660 $cm^{-1}$, 1600 $cm^{-1}$, 1080 $cm^{-1}$ and 835 $cm^{-1}$ infrared absorbance intensities were measured for each. The alkalinity value (TBN) of each was determined (ASTM D-2896). The percent calcium and sulfur of each sample was determined by X-ray diffraction. The percent glycol was determind by gas chromatography. The results are summarized in Table III. Also shown for comparison is a sample (PS-0812) prepared using the prior art (U.S. Pat. No. 2,680,096) and a commercial sample (OLOA-2165) 216S available from Chevron Chemical Company, San Francisco, Calif. The data indicate that as the ratio of A1660 $cm^{-1}$/A1600 $cm^{-1}$ decreased, the TBN/Ca ratio increased, even though the calcium content was approximately the same, or even decreased, indicating that total calcium content was not completely determinative of the total base number (TBN) of the compound. The data also indicate that the ratio of A1080 $cm^{-1}$/A835 $cm^{-1}$ decreased with the percent glycol. The samples prepared according to this invention gave smaller ratios of both A1660 $cm^{-1}$/A1600 $cm^{-1}$ and A1080 $cm^{-1}$/A835 $cm^{-1}$.

TABLE II

| Example No. | II | III |
|---|---|---|
| Sample No. | PS-1115 | PS-1233 |
| Reaction Stoichiomety | | |
| mole glycol/mole DDP* | 0.72 | 0.75 |
| mole sulfur/mole DDP | 0.95 | 0.99 |
| mole lime/mole DDP | 0.74 | 0.73 |
| lbs 5W Oil/lb-mole DDP | 270 | 200 |
| Processing Conditions | | |
| Prereactor | | |
| Temperature, °F. | 350 | 350 |
| Residence Time, Min. | 1 | 1 |
| First Reactor | | |
| Temperature, °F. | 370 | 370 |
| Residence Time, Min. | 120 | 120 |
| Second Reactor | | |
| Temperature, °F. | 440 | 420 |
| Residence Time, Min. | 120 | 120 |
| Stripper | | |
| Temperature, °F. | 480 | 480 |
| Vacuum, torr | 150 | 150 |
| Residence Time, Min. | 30 | 30 |
| Filter Temperature, °F. | 360 | 360 |

*DDP = Dodecylphenol

TABLE III

| Sample No. | PS-1115 | PS-1233 | PS-0812 | OLOA-2165 |
|---|---|---|---|---|
| Additive Analysis | | | | |
| Ca (wt) % | 4.2 | 4.9 | 4.6 | 5.0 |
| S (wt) % | 2.5 | 2.8 | 2.8 | 3.6 |
| Glycol (wt) % | 0.4 | 0.5 | 2.1 | 1.5 |
| TBN | 116 | 136 | 122 | 135 |
| TBN/Ca | 27.6 | 27.8 | 26.5 | 27.0 |
| A1660 $cm^{-1}$/A1600 $cm^{-1}$ | 0.19 | 0.08 | 0.53 | 0.32 |
| A1080 $cm^{-1}$/A835 $cm^{-1}$ | 0.16 | 0.18 | 0.38 | 0.35 |

EXAMPLE IV

Caterpillar IG2 engine tests were performed with a railroad diesel oil formulation containing sulfurized calcium phenates as detergents and antioxidants. The formulation also contained a dispersant and a low base sulfonate.

The Caterpillar engine test uses a single cylinder 133.5 CID supercharged diesel engine at 1800 RPM with 5850 BTU/minute 0.4 (wt)% sulfur fuel input while oil temperature is maintained at 205° F. (96° C.) After 120 hours and 480 hours operation the engine is dismantled and lubricating oil characteristics determined as to (a) ring sticking, (b) ring and cylinder wear, and (c) accumulation of piston deposits.

The Caterpillar 1G2 engine tests results of the four sulfurized calcium phenates were as follows:

TABLE IV

| | Caterpillar 1G2 Engine Test Results | | | | | | | |
|---|---|---|---|---|---|---|---|---|
| | Oil No. | | | | | | | |
| | LD-2425 | | LD-2410 | | LD-2002 | | LD-2423 | |
| | Phenate No. | | | | | | | |
| | PS-1115 | | PS-1233 | | PS-0812 | | OLOA-216S | |
| Time-Hrs. | 120 | 480 | 120 | 480 | 120 | 480 | 120 | 480 |
| TGF % | 21 | 17 | 51 | 57 | 35 | 61 | 32 | 61 |
| WCD | 69 | 115 | 125 | 165 | 93 | 229 | 109 | 216 |
| WLD | 117 | 220 | 86 | 149 | 143 | 244 | 182 | 262 |
| WTD | 186 | 335 | 211 | 314 | 236 | 472 | 291 | 478 |

NOTES:
TGF - Top Grove Fill
WCD - Weighted Carbon Deposits
WLD - Weighted Lacquer Deposits
WTD - Weighted Total Deposits Both PS-1115 and PS-1233 gave relatively small ratios of A1660 $cm^{-1}$/A1600 $cm^{-1}$ and A1080 $cm^{-1}$/A835 $cm^{-1}$. Therefore, they performed well in the engine tests. OLOA-216S and PS-0812 performed poorly in the engine tests due to their more significant ratios of A1660 $cm^{-1}$/A1600 $cm^{1}$ and A1080 $cm^{-1}$/A835 $cm^{-1}$.

Other property improvements include: better silver lubricity, less corrosive (as measured by the amount of reducible sulfur), and improved phenate-sulfonate compatibility. The results are summarized in Table V.

TABLE V

| Sample No. | PS-1115 | PS-1233 | PS-0812 | OLOA-216S |
|---|---|---|---|---|
| Additive Property | | | | |
| Silver Lubricating mm wear at 500° F. | 1.4 | 1.4 | 2.0 | 1.8 |
| Reducible Sulfur (wt) % | — | 0.07 | 0.26 | 0.15 |
| Phenate-Sulfonate Compatibility, Vol % Sediment | 0.5 | 0.5 | 3.0 | 6.5 |

What is claimed is:

1. A process for making a lubricating oil additive composition with improved dispersant and anti-oxidant capabilities which comprises:
(a) reacting a polyhydroxy compound with an alkaline earth metal compound in the presence of an alkylphenol at a temperature within the range of from about 300° F. to about 350° F. for a period of from 10 seconds to 60 seconds,
(b) adding elemental sulfur to the reaction mixture of (a),
(c) heating the reaction mixture of (b) at a temperature within the range of from about 360° F. to about 380° F. for a period of from about 1 to about 2 hours,
(d) heating the reaction mixture of (c) at a temperature within the range of from about 420° F. to about 460° F. for a period of from about 1 to about 2 hours,
(e) nitrogen-stripping the reaction product of (d) at a temperature within the range of from about 470° F. to about 490° F.,
(f) filtering the nitrogen-stripped product of (e) whereby said finished product has an infrared absorbance ratio of less than 0.2 for A1660 $cm^{-1}$/A1600 $cm^{-1}$ and also for A1080 $cm^{-1}$/A835 $cm^{-1}$.

2. The lubricating oil additive composition prepared by the process of claim 1 wherein infrared absorbance ratio of A1660 $cm^{-1}$/A1600 $cm^{-1}$ is less than 0.2 and absorbance ratio of 1080 $cm^{-1}$/A835 $cm^{-1}$ is also less than 0.2.

3. The process of claim 1 wherein said polyhydroxy compound is selected from the group consisting of ethylene glycol, propylene glycol; butane diol-2,3; pentane diol-2,3; and 2-methylbutane diol-3,4.

4. The process of clalm 1 wherein said polyhydroxy compound is ethylene glycol.

5. The process of claim 1 wherein said alkylphenol is of the formula $R(C_6H_3)OH$ wherein R is a straight claim or branched chain alkyl group having from 8 to 40 carbon atoms.

6. The process of claim 1 wherein said alkylphenol is selected from the group consisting of octylphenol, decylphenol, dodecylphenol, tetradecylphenol, hexadecylphenol, triacontylphenol and up to tetracontylphenol.

7. The process of claim 1 wherein said alkylphenol is dodecylphenol.

8. The process of claim 1 wherein said alkaline earth metal compound is selected from the group consisting of calcium oxide and calcium hydroxide.

9. The process of claim 1 wherein said alkaline earth metal compound is calcium hydroxide.

10. The process of claim 1 wherein the mole ratio of said polyhydroxy compound to said alkylphenol is in the range of from about 0.6 to about 0.8.

11. The process of claim 1 wherein the mole ratio of said sulfur to said alkylphenol is in the range of from about 0.8 to about 1.2.

12. The process of claim 1 wherein the mole ratio of said alkaline earth compound to said alkylphenol is in the range of from about 0.6 to about 0.8.

13. The process of claim 1 wherein said process is a batch process.

14. The process of claim 1 wherein said process is a continuous process.

15. The process of claim 1 wherein said polyhydroxy compound is ethylene glycol, said alkaline earth metal compound is calcium hydroxide, said alkylphenol is dodecylphenol, said sulfur is elemental sulfur and said process is continuous.

* * * * *